US005286022A

United States Patent [19]

You

[11] Patent Number: 5,286,022

[45] Date of Patent: Feb. 15, 1994

[54] METAL GAME RACKET

[76] Inventor: Chin-San You, No. 3, Lane 1029, Feng-Shyn Rd., Feng Yuan City, Taiwhung Hsien, Taiwan

[21] Appl. No.: 80,811

[22] Filed: Jun. 24, 1993

[51] Int. Cl.[5] ..... A63B 49/06

[52] U.S. Cl. ..... 273/73 H; 273/73 K

[58] Field of Search ..... 273/73 R, 73 C, 73 F, 273/73 G, 73 H, 73 J, 73 K

[56] References Cited

U.S. PATENT DOCUMENTS

| | | | |
|---|---|---|---|
| 4,855,173 | 8/1989 | Dore | 273/73 F X |
| 5,135,223 | 8/1992 | You | 273/73 J |
| 5,174,568 | 12/1992 | You | 273/73 F |
| 5,178,387 | 1/1993 | Knebler | 273/73 R X |
| 5,236,198 | 8/1993 | Haines et al. | 273/73 R |

FOREIGN PATENT DOCUMENTS

| | | | |
|---|---|---|---|
| 787895 | 9/1935 | France | 273/735 |
| 435253 | 9/1935 | United Kingdom | 273/735 |

*Primary Examiner*—William Stoll

*Attorney, Agent, or Firm*—Browdy and Neimark

[57] ABSTRACT

A game racket frame of metal material comprises a head frame, a handle, and a throat located between the handle and the head frame. The handle has a shaft portion which has one end that is coupled with the throat and another end extending axially and outwardly to form a hand grip. The hand grip is provided with an area adjacent to the shaft portion and having therein at least a slit of a width measured in a direction perpendicular to the longitudinal axis of the area. The width of the slit is at least corresponding to 3% of the circumferential length of any cross section of the area. The slit serves to interrupt and attenuate the shock wave that is generated by the head frame upon hitting a ball and is subsequently transmitted to the handle.

16 Claims, 3 Drawing Sheets

METAL GAME RACKET

FIELD OF THE INVENTION

The present invention relates generally to a game racket, and more particularly to an improved metal game racket which is capable of effectived mitigating the shocking exerting on the hand of a player.

BACKGROUND OF THE INVENTION

The prior art game racket of a metal material, such as an aluminium alloy, can be made easily at a low cost and is still in demand. However, such a metal game racket is vulnerable to a severe vibration upon hitting a ball. In order to overcome the problem of vibration, a prior art reference discloses a metal game racket having a shock-absorbing casing, which is disposed at the top end of the connection portion between the shaft and the hand grip. The shock-absorbing casing is used to attenuate the intensity of shock that is generated by the metal game racket upon hitting a ball; nevertheless the shock-absorbing casing is in fact an ineffective remedy. Another prior art reference suggests a metal game racket having a head frame and a neck portion, which are provided respectively with a surface layer of a continuous helical construction. Such a surface layer is used to weaken the shock wave that is generated by the metal game racket upon hitting a ball. However, the surface layer is also ineffective in attenuating the shock wave of the metal game racket. In fact, these two prior art references suggest two kinds of shock-absorbing means, which are similar in approach in that they all try to attenuate the shock by providing the surface of the metal racket frame with a shock-absorbing means. In other words, the "surface approach" is ineffective in attenuating the shock wave of the metal game racket.

SUMMARY OF THE INVENTION

It is therefore the primary objective of the present invention to provide an improved metal game racket which is capable of reducing effectively the intensity of the shock generated by a game racket upon hitting a ball.

The foregoing objective of the present invention is attained by a metal game racket, which comprises a head frame, a handle and a throat portion connecting the head frame and the handle. The handle has a shaft portion which has one end that is coupled with the throat portion and has another end that extends outwards and axially to form a hand grip. The hand grip is provided at an area thereof adjacent to the shaft portion with at least one slit of a predetermined width which is measured in a direction perpendicular to the longitudinal axis of the area. The width of the slit is at least corresponding to 3% of the circumferential length of any one of the cross sections of the area where the slit is located. As a result, the shock wave, which is generated by the head frame upon hitting a ball, can be so effectively attenuated by the slit that the arm of a player holding the hand grip of the metal game racket will not be hurt.

DETAILED DESCRIPTION OF THE INVENTION

Figure 1:
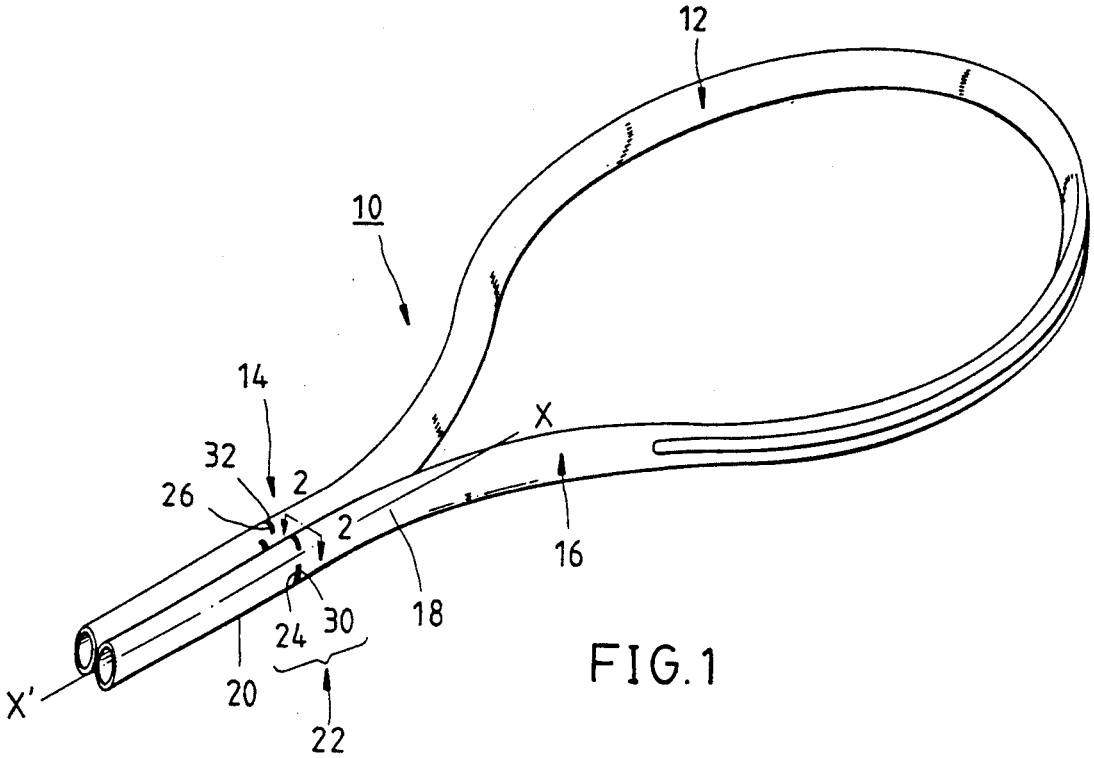
FIG. 1 shows a partial perspective view of a first preferred embodiment of the present invention.

Referring to FIGS. 1–4, a metal game racket frame 10 of the first preferred embodiment of the present invention is shown to comprise a head frame 12, a handle 14 and a throat portion 16 connecting the head frame 12 and the handle 14. The racket frame 10 is made of an aluminium alloy tube having an oval cross section.

The aluminium alloy tube has two end portions, which are parallel to each other and are joined together to form the handle 14, which has a shaft portion 18 having one end that is coupled with the throat portion 16 and having another end that extends axially and outwardly to form a hand grip 20.

Figure 2:
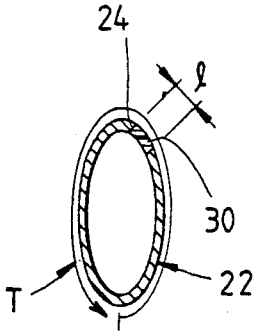
FIG. 2 shows a sectional view of a portion taken along the line 2—2 as shown in FIG. 1.
Figure 3:
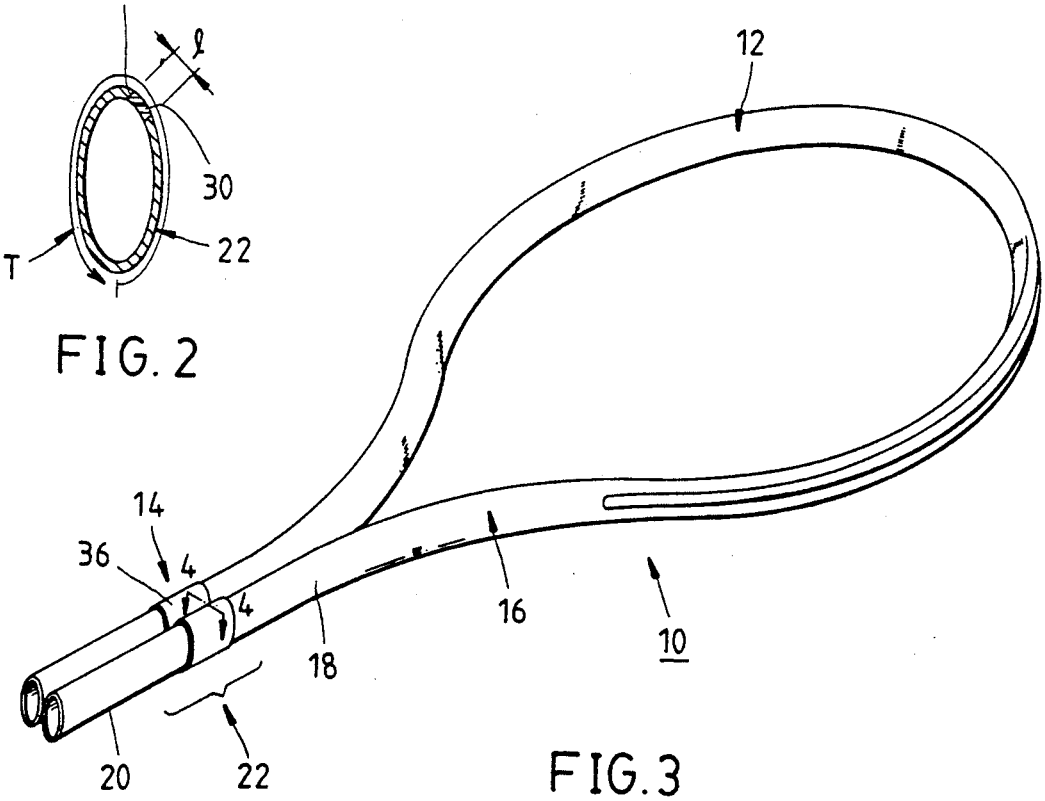
FIG. 3 shows a perspective view of the first preferred embodiment of the present invention.

The hand grip 20 has a predetermined area 22 adjacent to the shaft portion 18. The area 22 is composed of two parallel aluminium tubes which are provided respectively with slits 24 and 26. The number of the slits 24 and 26 depends on the requirement of the shock-absorbing effect. Each of the slits 24 and 26 has a width which is measured in a direction perpendicular to the longitudinal axis X—X' of the area 22. The width l of the slit is at least corresponding to 3% of the circumferential length T of a cross section of the area 22, as shown in FIG. 2. Upon the completion of the formation of the slits 24 and 26, they are filled respectively with buffers 30 and 32 which may be made of a thermosetting material, such as an epoxy resin or a thermoplastic material like nylon.

Figure 4:
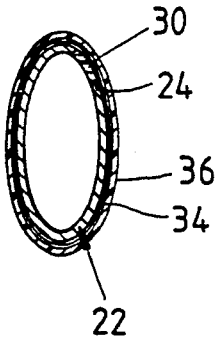
FIG. 4 shows a sectional view of a portion taken along the line 4—4 as shown in FIG. 3.

The structural strength of the game racket frame 10 of the present invention will not be undermined by a substantial increase in the number of the slits 24 and 26, if the area 22 is provided thereon with a reinforcing layer 34, as shown in FIG. 4. The reinforcing layer 34 is made of a fiber-reinforced plastic material, such as a carbon fiber fabric sheet preimpregnated with epoxy resin. The reinforcing layer 34 is covered with an elastic cover 36 made of a polymer, such as a natural rubber or a neoprene.

Figure 5:
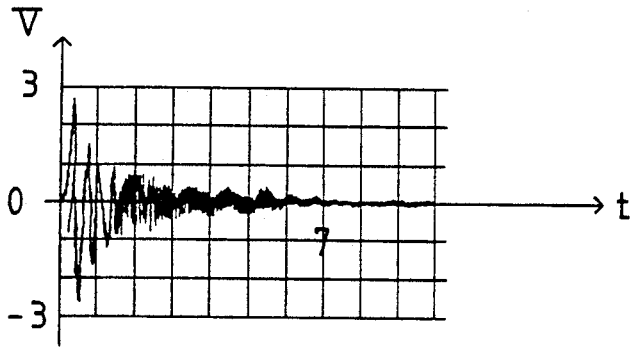
FIG. 5 is a diagram showing the result of a test of the shock attenuation, according to the first preferred embodiment of the present invention.
Figure 6:
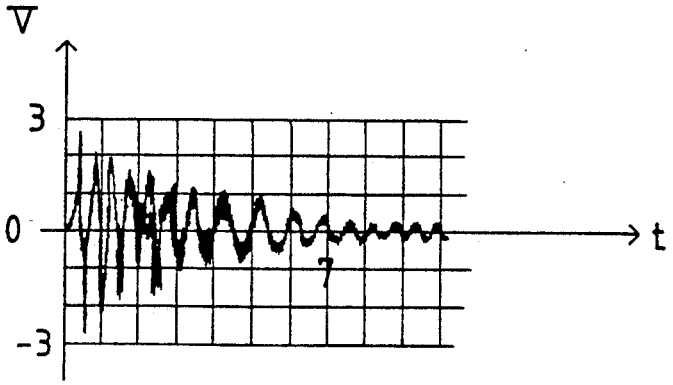
FIG. 6 is a diagram showing the result of a test of the shock attenuation of a prior art game racket of aluminium alloy.

When the head frame 12 hits a ball, a shock wave is generated in the head frame 12. The shock wave is effectively interrupted and therefore attenuated at the time when the shock wave is transmitted from the head frame 12 to the area 22 where the slits 24 and 26 are located. As a result, a player's hand holding the game racket 10 of the present invention is not vulnerable to an injury caused by the shock wave. In addition, the structural strength of the area 22 is by no means undermined by the slits 24 and 26, in view of the fact that the area 22 is effectively reinforced by means of buffers 30 and 32, and a reinforcing layer 34 which is further reinforced by an elastic cover 36. The inventor of the present invention has done a series of comparative shock-absorbing tests of the game racket frame 10 of the present invention and the prior art game racket of aluminium alloy which was purchased from the market. The test results are shown respectively in FIGS. 5 and 6, in which the prior art game racket is shown to have a wave amplitude of 0.5 V at the seventh second as compared with a zero wave amplitude of the game racket frame 10 of the present invention. Such test results suggest that the metal game racket frame 10 of the present invention is not vulnerable to breakage if the game racket frame 10 of the present invention is subjected at the midpoint thereof to a load of 160 kgf at a velocity of 20 mm per minute. Such a performance record of the present invention as described above exceeds the load of 80 kgf that is generally accepted as a bench mark.

Figure 7:
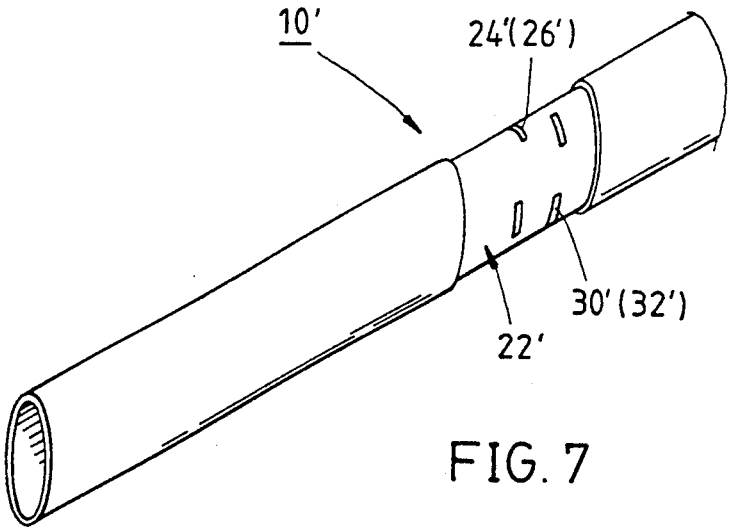
FIG. 7 shows a partial perspective view of a second preferred embodiment of the present invention.
Figure 8:
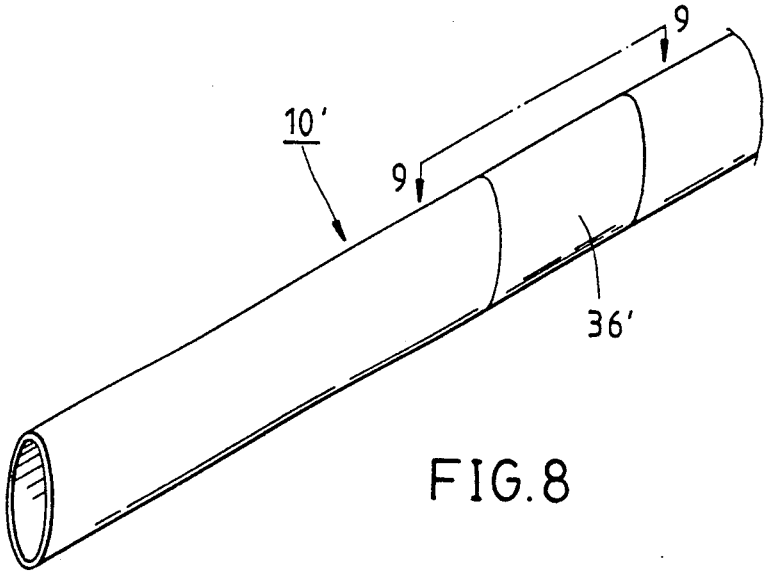
FIG. 8 shows another perspective view of the second preferred embodiment of the present invention.
Figure 9:
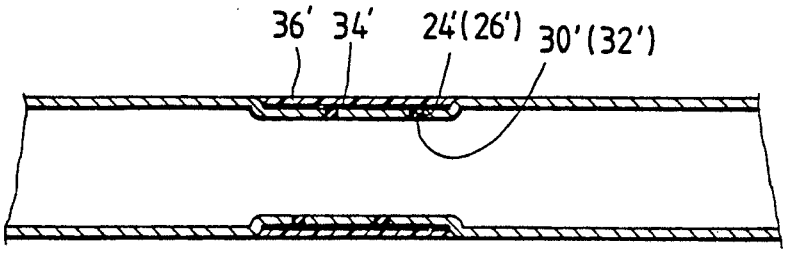
FIG. 9 shows a sectional view of a portion taken along the line 9—9 as shown in FIG. 8.

The second preferred embodiment of the present invention is illustrated in FIGS. 7–9, in which a game racket frame 10' is shown to comprise a recess area 22' of circular construction. There are slits 24' and 26' which are constructed in the recess area 22' and which are filled respectively with buffers 30' and 32'. The recess area 22' is reinforced by a reinforcing layer 34' which is in turn shielded by an elastic cover 36'. As a result, the surface of the handle of the game racket frame 10' of the present invention is so smooth as to facilitate the finishing of the game racket frame 10'.

What is claimed is:

1. A game racket frame of metal material comprising a head frame, a handle, and a throat connecting said handle and said head frame, said handle having a shaft portion which has one end that is coupled with said throat portion and another end that extends axially to form a hand grip; wherein said hand grip is provided with an area adjacent to said shaft portion and having at least one slit of a predetermined width that is measured in a direction perpendicular to the longitudinal axis of said area, said width of said slit being at least corresponding to 3% of the circumferential length of a cross section of said area.

2. The game racket frame of claim 1 wherein said area of said hand grip is a recess area of circular construction.

3. The game racket frame of claim 1 wherein said slit is filled with a buffer.

4. The game racket frame of claim 3 wherein said buffer is made of a thermosetting material.

5. The game racket frame of claim 3 wherein said buffer is made of a thermoplastic material.

6. The game racket frame of claim 3 wherein said slit is provided thereon with a reinforcing layer adhered securely thereto.

7. The game racket frame of claim 6 wherein said reinforcing layer is made of a fiber-reinforced plastic material.

8. The game racket frame of claim 6 wherein said area provided with said slit has an elastic cover formed thereon.

9. The game racket frame of claim 8 wherein said elastic cover is made of a polymer.

10. The game racket frame of claim 3 wherein said area provided with said slit has an elastic cover formed thereon.

11. The game racket frame of claim 1 wherein said slit is provided thereon with a reinforcing layer adhered securely thereto.

12. The game racket frame of claim 11 wherein said reinforcing layer is made of a fiber-reinforced plastic material.

13. The game racket frame of claim 6 wherein said area provided with said slit has an elastic cover formed thereon.

14. The game racket frame of claim 13 wherein said elastic cover is made of a polymer.

15. The game racket frame of claim 1 wherein said area provided with said slit has an elastic cover formed thereon.

16. The game racket frame of claim 15 wherein said elastic cover is made of a polymer.

* * * * *